United States Patent [19]

Flum et al.

[11] Patent Number: 4,801,025

[45] Date of Patent: Jan. 31, 1989

[54] ADJUSTABLE SHELF ORGANIZER UNITS HAVING FRANGIBLE SIDE AND REAR PORTIONS

[75] Inventors: Paul L. Flum, Ladue; Christopher C. Bidwell, Richmond Heights, both of Mo.

[73] Assignee: Paul Flum Ideas, Inc., St. Louis, Mo.

[21] Appl. No.: 907,056

[22] Filed: Sep. 12, 1986

[51] Int. Cl.[4] ..... A47F 5/00

[52] U.S. Cl. ..... 211/128; 211/59.2; 211/153; 211/188

[58] Field of Search ..... 211/59.2, 134, 60.1, 211/126, 186, 11, 188, 153, 128; 312/42, 45

[56] References Cited

U.S. PATENT DOCUMENTS

| | | | |
|---|---|---|---|
| 3,648,849 | 3/1972 | Harris et al. | 211/126 |
| 4,314,648 | 2/1982 | Spamer | 211/59.2 |
| 4,364,481 | 12/1982 | Ricci | 211/184 |
| 4,478,337 | 10/1984 | Flum | 211/126 X |
| 4,496,037 | 1/1985 | Spamer | 211/153 X |
| 4,565,725 | 1/1986 | Spamer et al. | 211/59.2 X |
| 4,593,823 | 6/1986 | Fershko et al. | 211/49.1 |
| 4,598,828 | 7/1986 | Young et al. | 211/59.2 |

*Primary Examiner*—Robert W. Gibson, Jr.
*Attorney, Agent, or Firm*—Haverstock, Garrett & Roberts

[57] ABSTRACT

An adjustable shelf unit adaptable to be supported on a support structure including frangible side and rear portions which can be easily detachably removed therefrom for adjusting both the depth and/or width of the unit to facilitate use on existing shelf structures having varying depths and widths. Removal of one or both of the frangible side portions provides shelf width adjustment whereas removal of the frangible rear portion provides shelf depth adjustment. The present shelf units are specifically designed for use both as a single shelf unit to more effectively organize and merchandise products therefrom and are likewise particularly adapted to be arranged in spaced apart relationship one above the other to form a two-tier product merchandising display system, which two-tier arrangement effectively doubles the avilable shelf capacity. The present shelf units can be conveniently supported in either a flat position or in an inclined position for gravity feeding products therefrom and are adaptable for use in many display applications.

38 Claims, 10 Drawing Sheets

ADJUSTABLE SHELF ORGANIZER UNITS HAVING FRANGIBLE SIDE AND REAR PORTIONS

The present invention relates generally to product display devices for use in storing and merchandising shelved products and, more particularly, to various embodiments of an adjustable shelf organizer unit which can be utilized as a single unit to organize and merchandise products therefrom and which units are likewise particularly adapted to be mounted in spaced apart relationship one above the other to provide a two-tier arrangement to increase and maximize available shelf capacity. The subject shelf units can be conveniently supported in a flat horizontal position or in an inclined position for gravity feeding products positioned thereon, some embodiments including a frangible rear portion which allow the depth of such units to be adjusted while other embodiments include frangible side and rear portions which may be detachably removed to provide both width and depth adjustment means. The subject devices are ideally suited for use on conventional shelving commonly utilized in supermarkets, convenience stores, and other food and beverage outlets including refrigerated coolers and, although the subject units are primarily designed for use in refrigerated display cases, they are likewise adaptable for use in many display shelf applications.

BACKGROUND OF THE INVENTION

A wide variety of display devices have been designed and manufactured for use in merchandising shelved products to consumers. One of the major problems associated with storing and displaying shelved products for sale to customers and, in particular, shelved products requiring refrigeration in display coolers and other types of cold vaults, is the inefficient use of available shelf space and the inability of a merchant to provide a constant, attractive arrangement of shelved products which are readily visible and easily accessible to the customer at the front portion of the shelf. Equally important has been the problem of overcoming the poor utilization of available shelf space in a manner that is both most efficient and at the same time cost effective.

Various product shelving displays have been designed to alleviate such problems, but all such devices suffer from certain disadvantages and shortcomings including being relatively large, bulky, awkward, expensive, and difficult, if not impossible, to use on shelf space presently available in supermarkets and other retail outlets, including the shelf space available in conventional refrigerated display coolers. Furthermore, none of the known devices and methods for storing and merchandising shelved products are as simple structurally as the subject constructions and none utilize as efficient and effective means for both improving the slidability and availability of products positioned thereon and providing an adjustable unit easily adapted to accommodate a wide variety of conventional shelving. In this regard, the known devices capable of width and depth adjustments require a plurality of separate units to provide a single product merchandising display device. An example of such a device is disclosed in U.S. Pat. No. 4,364,481 which requires at least three separate elements each of which is specially constructed so that respective portions may be broken away to adjust both the depth and width thereof, the separate elements interlocking with one another to provide product troughs of various widths. Also, U.S. Pat. No. 4,593,823 discloses a gravity feed type system wherein only the side portions of the individual units are removable. U.S. Pat. No. 4,593,823 also discloses a two-tier system which utilizes means for achieving the two-tier arrangement which are substantially different from the means of the subject invention, namely, a different bracket design as well as a plurality of alternate bracket receiving means which must be used for attaching each individual bracket to the system. The shelving units of the subject invention as well as the means for arranging said units in a two-tier system is clearly distinguishable over the above known prior art.

SUMMARY OF THE PRESENT INVENTION

The present product merchandising devices overcome many of the disadvantages and shortcomings associated with known display devices, and teach the construction and operation of several embodiments of an adjustable shelving unit adaptable for use on and with existing shelving equipment, either on a flat shelf or on an inclined support structure for gravity feeding products therefrom. The subject shelf units are constructed for use both as a single shelf unit to organize and merchandise products therefrom and are likewise particularly adapted to be mounted in spaced apart relationship one above the other to form a two-tier system, their use either singularly or in a two-tier arrangement depending upon the particular display application desired. The two-tier system effectively doubles the available shelf capacity.

Each of the several embodiments of the present invention includes a shelf member preferably of a one-piece plastic construction having opposed side walls and opposed front and rear walls with a floor portion extending therebetween. The shelf member also include a plurality of parallel guide members extending between the front and rear walls defining a plurality of parallel adjacent guide channels for guiding products positioned therein in parallel rows. Track members are removably attachable to or are integrally formed with the floor portion within each guide channel and likewise extend between the front and rear wall portions thereby forming a support bottom in each respective channel for supporting products positioned thereon.

An important feature of the subject invention includes novel means for adjusting the depth and/or the width of each shelving member to facilitate accommodating the units on existing shelves having varying depths and widths. The adjusting means includes frangible portions along opposite side walls of the shelf member and/or along the rear wall thereof, which frangible side and rear portions are easily broken off along weakened fracture lines formed in the shelving members during the manufacture thereof. The subject shelf devices are adaptable for use in a wide variety of merchandising shelf applications, although it is anticipated that the subject units will be utilized primarily in refrigerated display coolers. In this regard, the subject shelf members include a plurality of apertures or vents extending through the floor portion and generally positioned in parallel rows along opposite sides of the respective guide channels, these apertures or vents allowing refrigerated air to circulate around and between the rows of products positioned in the respective guide channels.

Another novel feature of the subject invention is the means by which a pair of the subject shelf members can be arranged in spaced apart relationship one above the other so as to increase the existing shelf capacity, such pair of shelf members being disposed in offset relationship such that the lower shelf unit extends forwardly of the upper shelf unit. This forward extension of the lower shelf unit is achieved through the use of specially designed C-shaped brackets which automatically provide for the necessary offset between the upper and lower shelving members. This arrangement offers several advantages to merchants and consumers as compared to prior art devices including simplifying the assembly of the two-tier system as will be hereinafter discussed. In addition, the natural or automatic offset associated with the two-tier shelving arrangement enables a customer to more easily grasp a product from either the upper or the lower unit, and especially from the lower unit, regardless of whether the two-tier arrangement is positioned on a horizontal or an inclined support structure.

The present invention further includes a separate track member adapted to be attached or mounted within each guide channel to facilitate movement of different types of containers along the track members.

Because of these capabilities, the present shelf members provide simple and efficient means for effectively utilizing shelf space; they provide for the orderly and attractive arrangement and display of products; they provide means for adjusting the overall width and/or depth of the subject devices to accommodate varying sizes and types of support structures; they provide effective means for enabling the circulation of refrigerated air around and between the rows of products positioned thereon when used in a refrigerated display cooler; and when used in a two-tier arrangement, they double the available shelf capacity.

It is therefore a principal object of the present invention to provide an efficient and attractive shelf organizer unit wherein the depth of the unit is adjustable to reduce the overall depth thereof.

Another object is to provide a shelf organizer unit that is structurally and operationally relatively simple, light-weight and inexpensive to manufacture and assemble.

Another object is to provide a shelf organizer unit wherein both the depth and width of the unit is adjustable to reduce the overall size thereof.

Another object is to provide a more efficient and simpler means for double-stacking a pair of the subject shelf units to provide increased packout within a given amount of shelf space.

Another object is to provide a two-tier display device including improved means in the form of specially designed bracket means for automatically off-setting the front walls associated with the upper and lower shelving units.

Another object is to provide an improved shelf organizer unit which affords maximum flexibility in more efficiently utilizing existing shelf space commonly utilized in supermarkets and other merchandising centers, including shelf space associated with refrigerated display coolers.

Another object is to provide a shelving unit which reduces and saves the vertical space between shelved products in certain display applications such as existing refrigerated coolers and other known adjustable shelf systems.

These and other objects and advantages of the subject invention will become apparent to those skilled in the art after considering the following detailed specification which discloses several representative embodiments of the present shelving units in conjunction with the accompanying drawings, wherein:

DETAILED DESCRIPTION OF THE DRAWINGS

Figure 1:
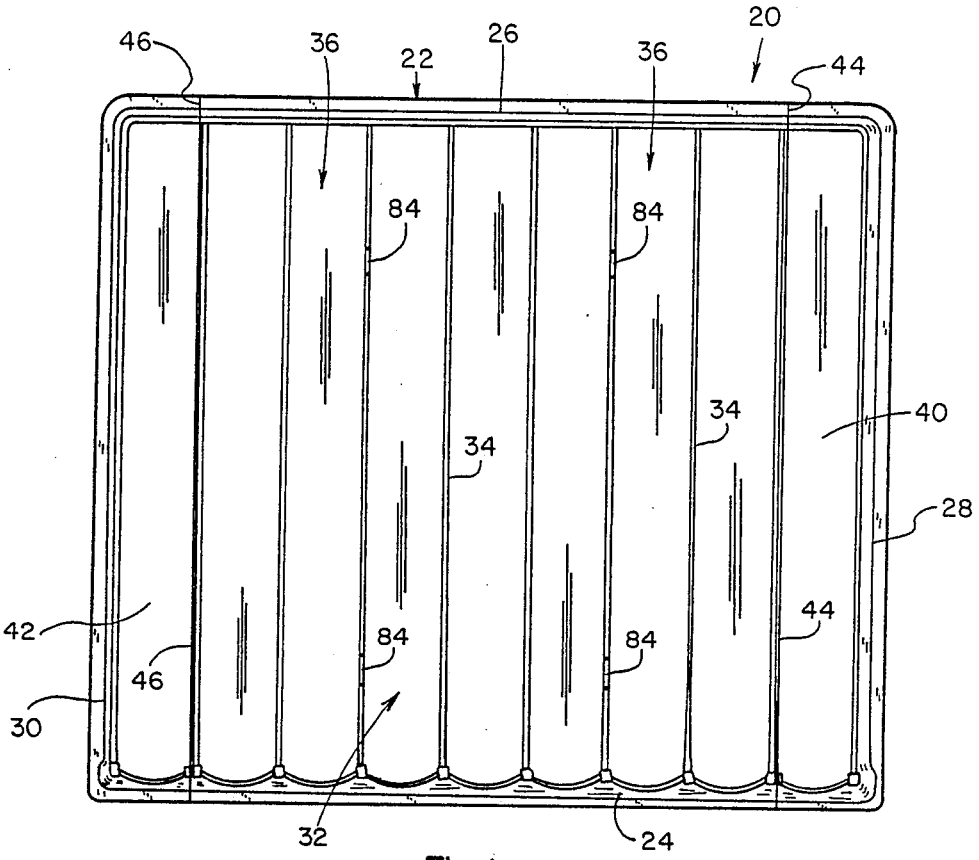
FIG. 1 is a top plan view of one embodiment of the subject shelving unit having frangible side portions located on the opposite sides thereof.

Referring to the drawings more particularly by reference numbers wherein like numerals refer to like parts, number 20 in FIG. 1 identifies a shelving unit constructed according to the teachings of the present invention. The shelving unit 20 is designed to support and merchandise products positioned thereon such as bottled and canned soft drink products and the like, and includes a generally one-piece rectangular base structure 22 adapted for use on a support structure such as shelving commonly employed by a wide variety of food and beverage outlets including shelving associated with conventional refrigerated display coolers and other types of cold vaults. The structure 22 includes spaced front and rear walls 24 and 26, spaced side walls 28 and 30, and a floor portion 32 which extends substantially the full length and width of the shelving unit 20 between the front, rear and side walls as shown in FIG. 1. The shelving unit 20 is primarily designed to be made by a thermo-forming process.

A plurality of spaced upstanding wall portions or partitions 34 extend substantially between the front and rear walls 24 and 26 and define therebetween a plurality of parallel guide channels 36 for supporting and guiding products therein in parallel rows. Each of the guide channels 36 is also defined by a portion of the floor 32 located between adjacent partitions 34. The partitions 34 are preferably integrally formed with the structure 22 for ease of manufacture and to lend strength and stability to the shelving unit 20, although other suitable means may be used to attach the partitions 34 to the structure 22. A track member 38 (FIGS. 2, 5, and 5A) is positioned in each of the respective guide channels 36 and likewise extends substantially between the front and rear walls 24 and 26. The track members 38 are preferably adhesively or chemically bonded to the guide channels 36 and act as the support surfaces upon which products rest and slide. The track members 38 are constructed so as to be easily installed, removed and replaced, which greatly facilitates maintenance of the device and eliminates the need to repair and/or replace the entire shelving unit 20 when the track members 38 wear out. In other embodiments of the present invention, the members 38 may be integrally formed with the shelf structure such as through an injection molding process as will be hereinafter further described.

Figure 2:
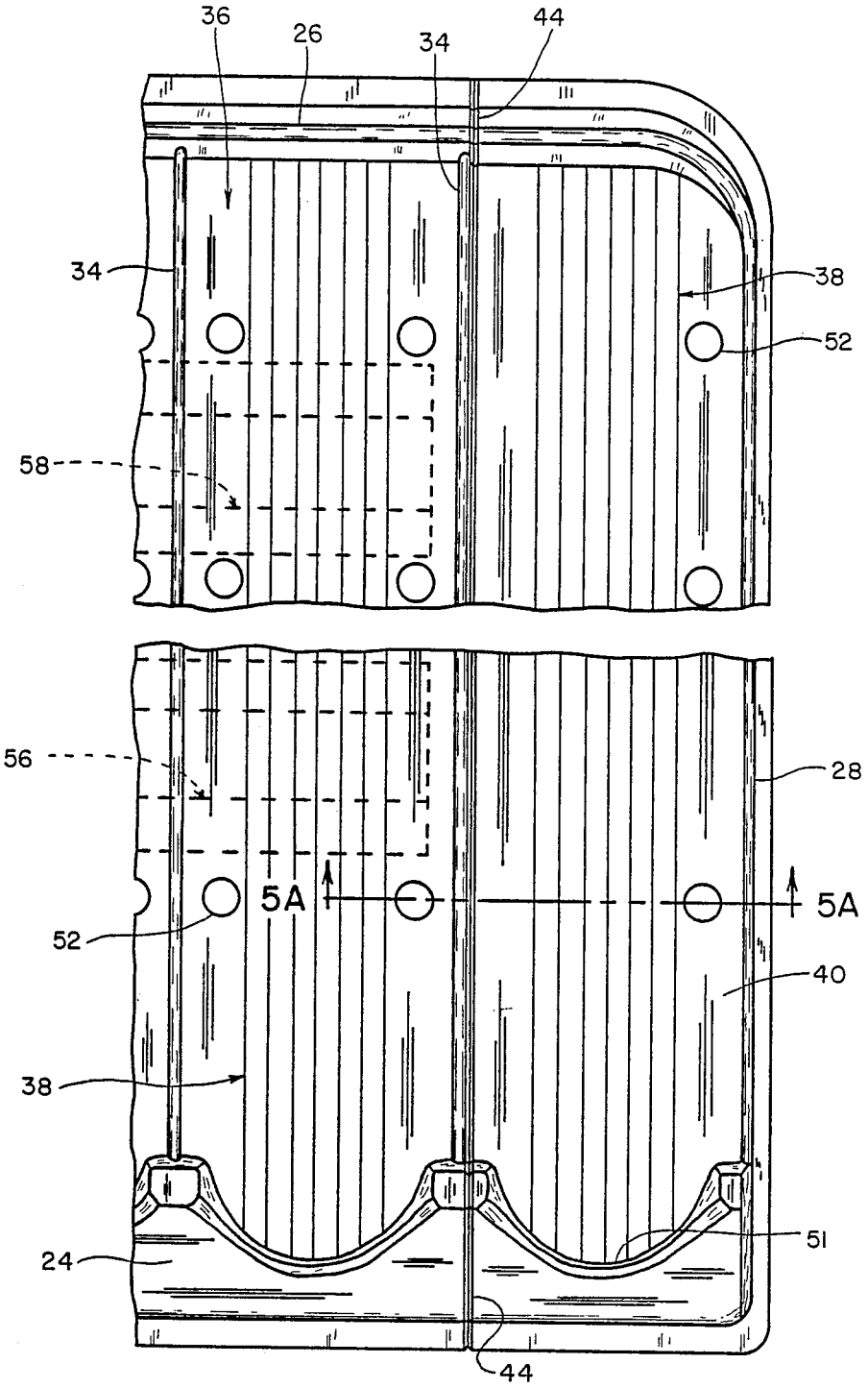
FIG. 2 is an enlarged fragmentary top plan view of a portion of the shelving unit of FIG. 1 showing the track members and ventilation openings positioned therewithin.
Figure 5:
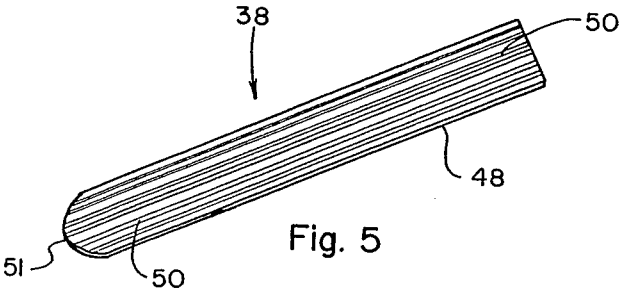
FIG. 5 is a fragmentary perspective view of one of the track members shown in FIG. 2.

The track members 38 (FIGS. 5 and 5A) each include a substantially flat base portion 48 with a plurality of spaced, longitudinally extending ribs or runners 50 projecting upwardly therefrom. The track members 38 are substantially the same length as the guide channels 36 but should be somewhat narrower so that they can be easily inserted into the channels 36. Also, the tracks 38 should be so dimensioned widthwise such that an uncovered floor space exists along both opposite sides thereof when positioned within the respective guide channels 36 so as to allow for the positioning of the vents or openings 52 which extend through the uncovered floor portions 32 as shown in FIG. 2. The openings 52 facilitate air circulation around the products positioned on the respective track members 38. At least one end 51 of each track member 38 is preferably rounded as shown in FIG. 5 to register with the rounded front edge portion of each guide channel 36 as best shown in FIGS. 1 and 2.

Figure 5A:
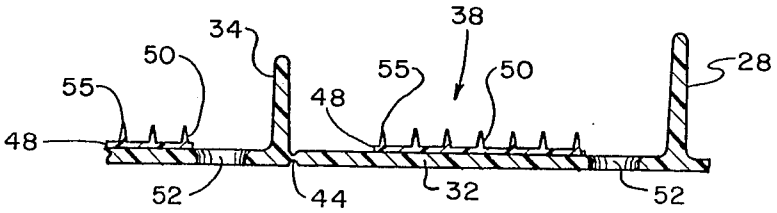
FIG. 5A is a cross-sectional view taken along line 5A—5A in FIG. 2.

The construction of the track members 38 as well as the materials and lubricants used to improve the slidability of products therealong are more fully described in U.S. Pat. Nos. 4,454,949 and 4,416,380, both of which were issued to the present assignee. However, the track members 38 represent an improvement over the known track means commonly used on gravity feed display devices as well as the construction of the track members disclosed in U.S. Pat. Nos. 4,454,949 and 4,416,380. The improvement lies in the fact that the ribs or runners 50 are made thinner in width and taller in height so as to provide longer wear. As best shown in FIG. 5A, the upstanding ribs or runners 50 are triangular shaped in cross-section and extend from the base portion 48 to an upper slightly rounded apex 55. The height of the ribs or runners 50 are substantially greater than the width thereof at the base portion 48 and it is this construction which produces longer wear. This is particularly so when the height of the ribs is at least twice as great as the width at the base. This also enables the track means 38 to be used in conjunction with product containers made of different types of materials and, in particular, glass bottom containers, since glass bottom containers cause the runners on the track members to wear more rapidly and would otherwise cause the track members to be more frequently replaced. This improved design obviates the need in most cases for a special track member designed specifically for handling glass bottom containers as will be hereinafter explained.

The shelving unit 20 shown in FIG. 1 is width adjustable and includes a pair of frangible or detachable side portions 40 and 42. The frangible side portion 40 is defined by and between the side wall 28 and a scored or weakened fracture line 44 that extends through and substantially the entire distance between the front and rear walls 24 and 26. The fracture line 44 includes a molded thin walled section of reduced cross-sectional area and extends adjacent to and along the outer side edge portion of the wall partition 34 located adjacent to the side wall 28 as shown in FIGS. 1 and 2. The frangible side portion 42 is similarly located at the opposite side of the shelf member 20, and is similarly defined by and between the side wall 30 and a weakened fracture line 46 formed along and adjacent to the outer side edge portion of the partition 34 located adjacent to the side wall 30 as shown in FIG. 1. Either one or both of the frangible side portions 40 and 42 may be easily detachably removed from the structure 22 so as to narrow the width thereof. This facilitates using the shelf unit 20 on shelves having varying widths and therefore substantially increases the usefulness and marketability of such unit.

Figure 3:
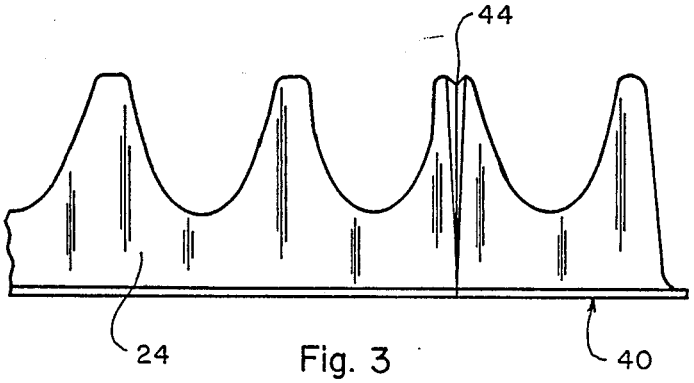
FIG. 3 is a fragmentary front view showing a portion of the front wall of the shelving unit of FIG. 1.
Figure 4:
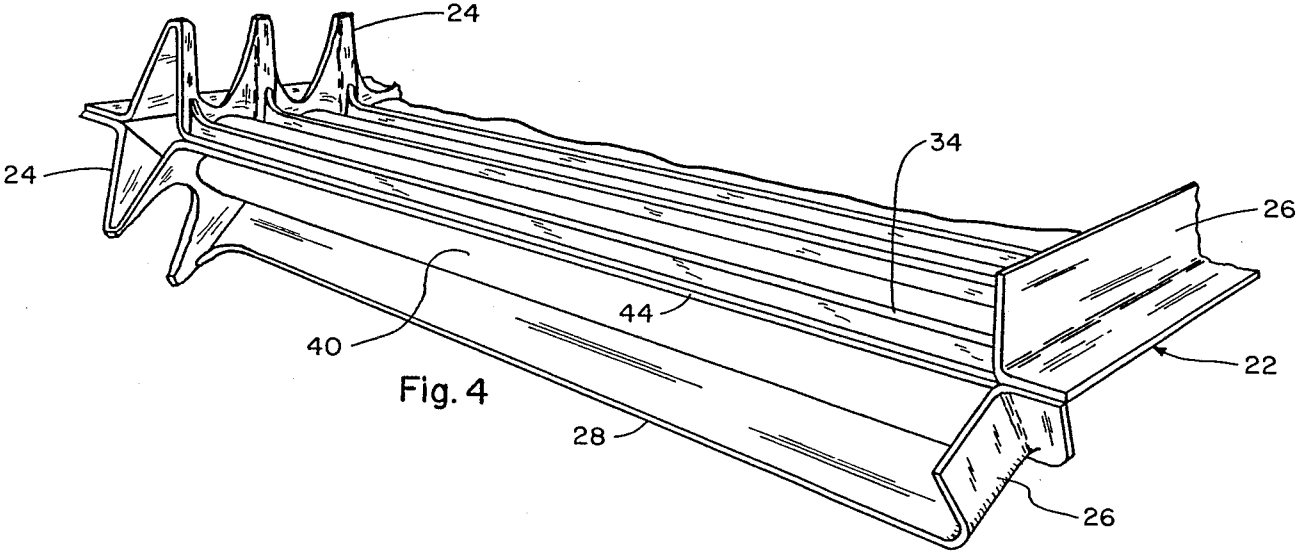
FIG. 4 is a fragmentary perspective view showing one of the frangible side portions of the shelving unit of FIG. 1 being detachably removed.

The procedure for fracturing and removing, for example, the frangible side portion 40 typically begins by fracturing the front wall 24 (FIG. 3) and the rear wall 26 at the locations where the weakened fracture line 44 extends therethrough. The front and rear walls 24 and 26 may be either weakened or scored along lines 44 and 46 to facilitate separating the frangible side portions 40 and 42 from the unit 20. The fracturing operation is best shown in FIG. 4. After first breaking through the front and rear wall portions 24 and 26 (FIGS. 2 and 3), the shelf structure 22 can be fractured along lines 44 and/or 46 to separate the frangible portions 40 and 42 therefrom. Fracturing the structure 22 can be easily accomplished by placing the unit on a flat support surface such as a table or desk and positioning the unit such that the fracture lines 44 and/or 46 extend along an edge of the table or other supporting surface. By pressing downwardly on the portion 40 and/or 42, the side portion 40 and/or 42 can be broken and easily torn therefrom. The molded thin walled sections associated with the respective fracture lines not only provide the snap off capability of the side portions 40 and 42 but also provide adequate strength to mitigate against the accidental breaking-off of the frangible side portions which is a problem with existing units that have removable sections. Weakening the structure 22 such as at the fracture lines 44 and 46 in accordance with the subject invention facilitates breaking off portions only along such fracture lines and prevents damage to the newly formed side edges. The side portion 40 is shown being broken away from the structure 22 in FIG. 4.

Figures 6, 7, 8:
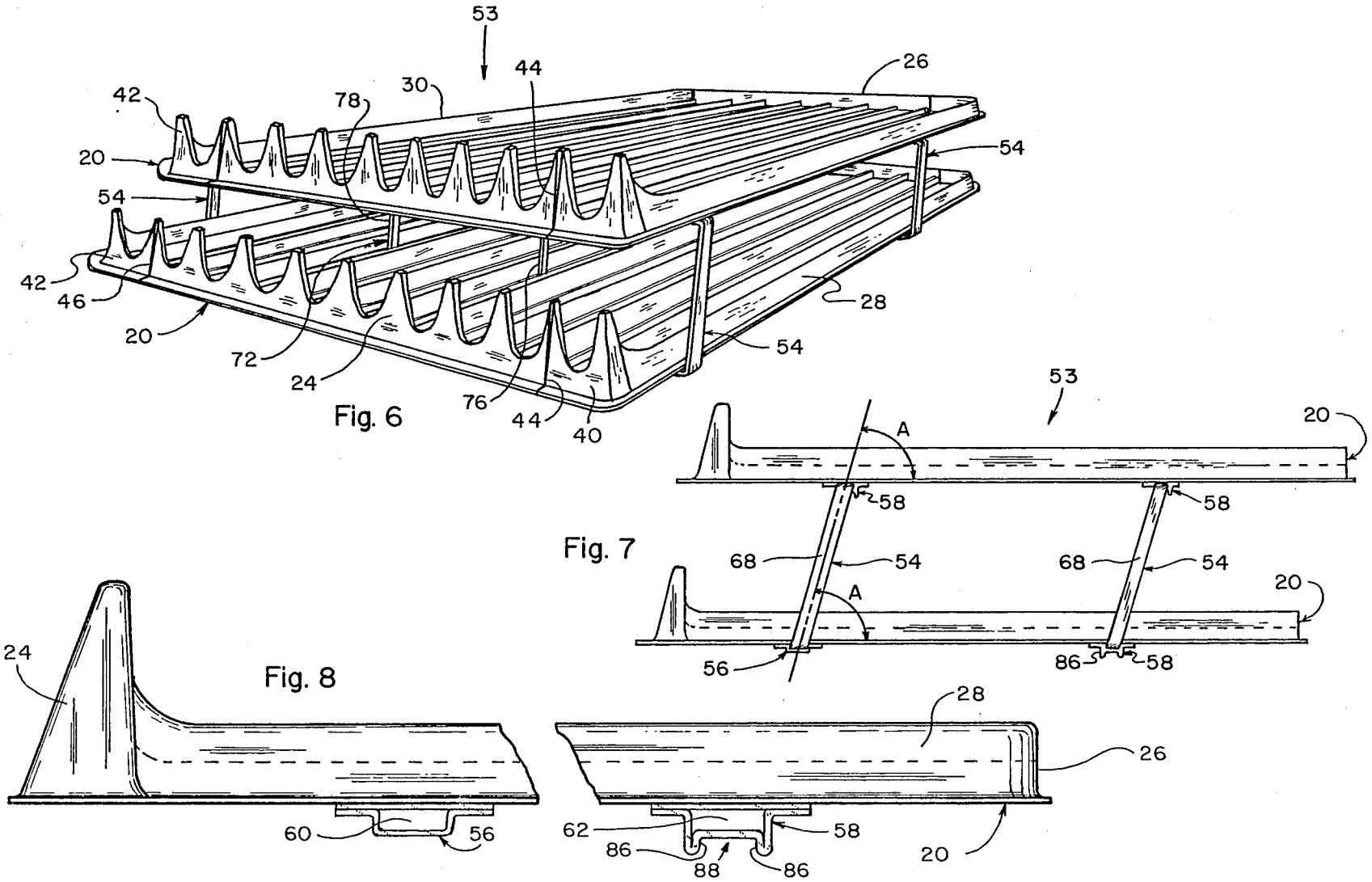
FIG. 6 is a perspective view of a pair of the shelving units of FIG. 1 arranged in spaced apart relationship one above the other to form a two-tier product merchandising display system.
FIG. 7 is a side elevational view of the two-tier display system of FIG. 6.
FIG. 8 is a side elevational view of the lower shelf member shown in FIGS. 6 and 7 with the bracket receiving means attached thereto.
Figure 9:
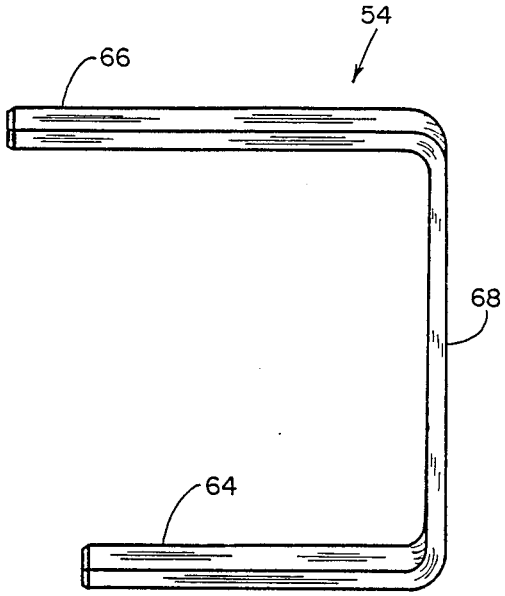

FIGS. 6 and 7 illustrate use of the subject shelving units 20 in a two-tier arrangement 53 wherein one shelf member is disposed in spaced apart relationship above a similar shelf member as shown. Mounting of the shelf members 20 one above the other is accomplished by use of specially designed C-shaped brackets such as the bracket 54 shown in FIGS. 9 and 10, which brackets are receivable within specially designed bracket receiving means such as the bracket receiving means 56 and 58 shown in FIGS. 7 and 8. As can be seen from FIGS. 7 and 8, bracket receiving means 56 and 58 are utilized on the lower shelf member 20 while only the receiving means 58 are utilized on the upper shelf member 20. It is recognized that the bracket receiving means 58 may likewise be utilized both fore and aft on the lower shelf member if so desired. The bottom surface of each shelving unit 20 is substantially flat and smooth so that each shelf 20 may be singularly utilized to organize and merchandise products therefrom. However, when the shelf units 20 are to be used in a two-tier arrangement, the appropriate bracket receiving means 56 and/or 58 must be permanently attached to the underside portion thereof by any suitable means such as by chemically bonding or sonic welding the same. The bracket receiving means 56 and 58 extend widthwise transversely across the guide channels 36 between the frangible side portions 40 and 42 as best shown in dotted outline form in FIG. 2. It is important that the receiving means 56 and 58 not extend outwardly beyond the fracture lines 44 and 46 so as not to interfere with removal of one or both of the frangible side portions 40 and/or 42 if so desired. The bracket receiving means 56 and 58 each include an opening or aperture 60 and 62 respectively adaptable to cooperatively receive one of the two leg portions associated with the C-shaped bracket members 54 as will be hereinafter explained. The receiving means 56 and 58 are preferably made of a plastic material although any other suitable material may likewise be utilized.

Figure 10:
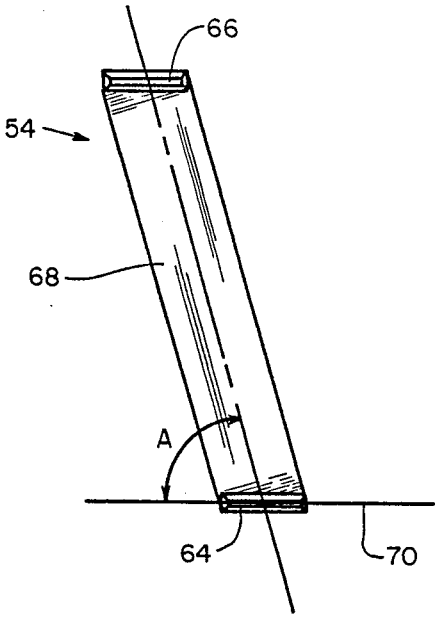
FIGS. 9 and 10 are front and side elevational views respectively of one of the C-shaped brackets utilized in the two-tier arrangement shown in FIGS. 6 and 7.

A pair of brackets 54 is utilized on each opposite end of the two-tier arrangement 53 shown in FIGS. 6 and 7. The brackets 54 are of identical construction and are somewhat C-shaped in form as shown in detail in FIGS. 9 and 10 except that the pair of brackets utilized on one side portion of the two-tier arrangement 53 are a mirror image of the pair of brackets utilized on the opposite side portion. This is necessary so that the front wall associated with the upper shelf unit 20 is laterally offset rearwardly as compared to the front wall associated with the lower shelf unit 20 as shown in FIGS. 6 and 7. The brackets 54 include a substantially horizontal lower leg portion 64, a substantially horizontal upper leg portion 66, and a vertically extending connecting portion 68. As best shown in FIGS. 7 and 10, the longitudinal dimension of the vertically extending connecting portion 68 is angularly related to the horizontal axis 70 of the leg portions 64 and 66 by an amount equal to the angle A so that the upper bracket leg portion 66 is offset rearwardly as compared to the lower bracket leg member 64. The spaced leg portions 64 and 66 are located parallel to each other and each is oriented at an angle acutely related to the longitudinal dimension of the connecting portion 68 as shown in FIG. 10. This is important because it is the angular relationship between the parallel leg portions 64 and 66 and the longitudinal dimension of the connecting portion 68 which achieves the offset between the upper and lower shelf units 20.

It has been found that an offset angle A of between about 16° to 17° provides a desirable condition such that the front wall of the upper shelf member 20 is sufficiently displaced rearwardly from the front wall of the lower shelf member 20 so as to enable a customer to more easily grasp and remove a product from the lower shelf member without interference. Product visibility and accessibility by a perspective customer is even more critical when the two-tier arrangement 53 (FIG. 6) is inclined to produce a gravity feed type system, as is its intended purpose. In an inclined orientation, if the offset between the upper and lower shelf units does not exist, it is apparent that the products positioned adjacent the front wall of the lower shelf unit would tend to be hidden or obscured underneath the front portion of the upper unit and access thereto would be somewhat limited. Although tests demonstrate that an offset angle A between about 16° to 17° is preferred, other angles may likewise provide suitable results for some applications depending upon the particular display arrangement, the nature of the goods being merchandised, and the actual shelf inclination being utilized.

The brackets 54 are designed such that the lower leg portion 64 is insertable within the respective apertures 60 and 62 associated with the bracket receiving means 56 and 58 attached to the underside portion of the lower shelf member 20 and the upper leg portion 66 is insertable within the apertures 62 associated with the bracket receiving means 58 attached to the underside portion of the upper shelf member 20. As noted in FIG. 9, the upper leg portion 66 of each bracket 54 is dimensioned somewhat longer than the lower leg portion 64 so as to provide greater support to the products positioned on the upper elevated shelf member 20. In this regard, it is important that the leg portions 66 be dimensioned such that when both frangible side portions 40 and 42 are detachably removed from the respective shelf units 20, the upper leg portions 66 will still be fully insertable within the respective bracket receiving means as shown in FIGS. 6 and 7. The brackets 54 are preferably made of a metal material although any other suitable type of material may be utilized so long as the material selected is able to adequately withstand and support the weight of the products to be positioned upon the upper shelf unit 20 without bendage and/or breakage.

Figure 11:
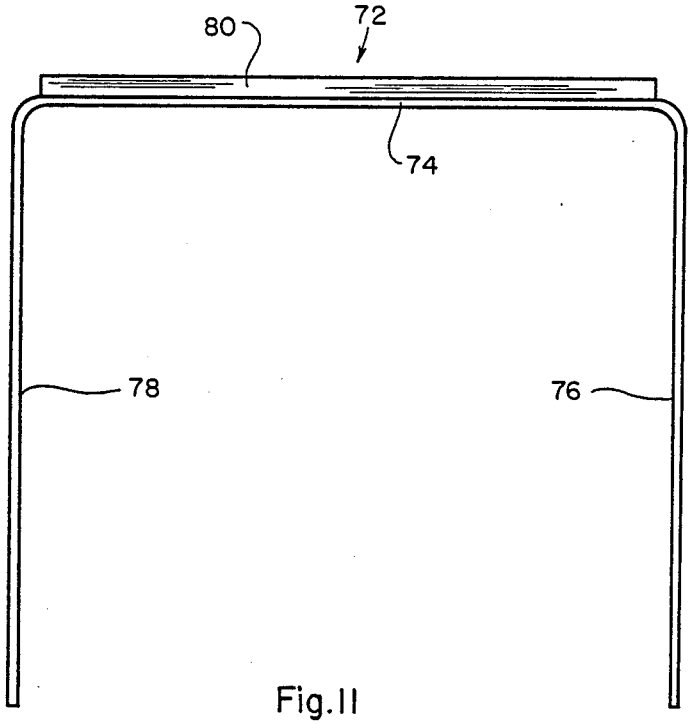
FIGS. 11 and 12 are front and side elevational views respectively of one of the U-shaped center support brackets utilized in the two-tier arrangement shown in FIGS. 6 and 7.
Figure 12:
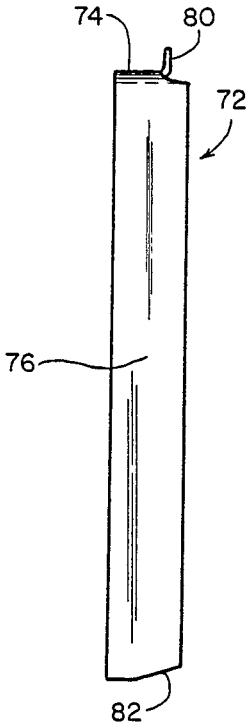

In order to provide additional support to the center portion of the upper shelf member 20 (FIG. 6), a pair of U-shaped center support brackets such as the bracket 72 shown in FIGS. 11 and 12 are provided. The support bracket 72 includes a top or cross portion 74 having a pair of laterally spaced substantially parallel leg portions 76 and 78 extending respectively therefrom as shown in FIG. 11. The top or cross portion 74 includes an upwardly extending flange portion 80 and the terminal end portion of each respective leg member 76 and 78 includes an angled portion 82 as best shown in FIG. 12. The support bracket 72 is preferably integrally casted or formed from metal or some other durable material. Slots 84 (FIG. 1) are provided on the appropriate upstanding wall portions or partitions 34 and are adaptable for receiving the terminal end portion of each of the respective leg portions 76 and 78. The slots 84 are positioned and arranged on the appropriate partitions 34 such that when the leg portions 76 and 78 are positioned therewithin, the cross portion 74 engages the bracket receiving means 58 associated with the upper shelf member 20. In this regard, each of the bracket receiving means 58 includes a pair of spaced apart substantially parallel wall portions 86 extending downwardly from the wall means forming the receiving aperture 62 so as to form a U-shaped cavity 88 as best shown in FIG. 8. When properly positioned within the slots 84, the cross portion 74 of the bracket 72 cooperatively engages the U-shaped cavity 88 as shown in FIG. 13.

Figure 13:
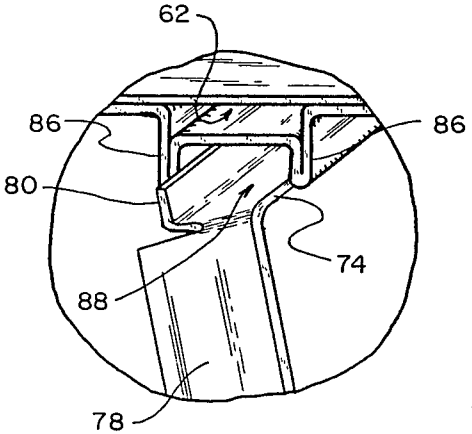
FIGS. 13 is a partial fragmentary perspective view showing how the upper portion of the center support bracket engages the bracket receiving means associated with the underside portion of the upper shelf member of FIGS. 6 and 7.

Referring to FIG. 13, it can be seen that the U-shaped support bracket 72 is positioned within the cavity 88 such that the flange portion 80 abuts the rearwardmost wall portion 86 while the front edge portion of the cross member 74 abuts the forwardmost wall portion 86. Also, when properly seated within the cavity 88, the cross member 72 is angularly oriented as shown in FIG. 13 such that the leg portions 76 and 78 are in alignment with the angular displacement associated with the vertically extending connecting portions 68 of the C-shaped brackets 54. Since the bracket leg members 76 and 78 actually rest upon the angled terminal end portion 82 associated respectively therewith, it is important that the amount of angularity be such that when properly seated within the slots 84, the bracket leg members are angularly displaced an amount approximately equal to the angle A associated with the brackets 54. Two such center support brackets 72 may be utilized with each two-tier arrangement 53 as shown in FIG. 6, the cross portion 74 associated with each respective bracket 72 being engageable with one of the bracket receiving means 58 associated with the upper shelf member 20. Only the leg portions 76 and 78 of the forwardmost center support bracket 72 are visible in the two-tier arrangement illustrated in FIG. 6.

Figure 14:
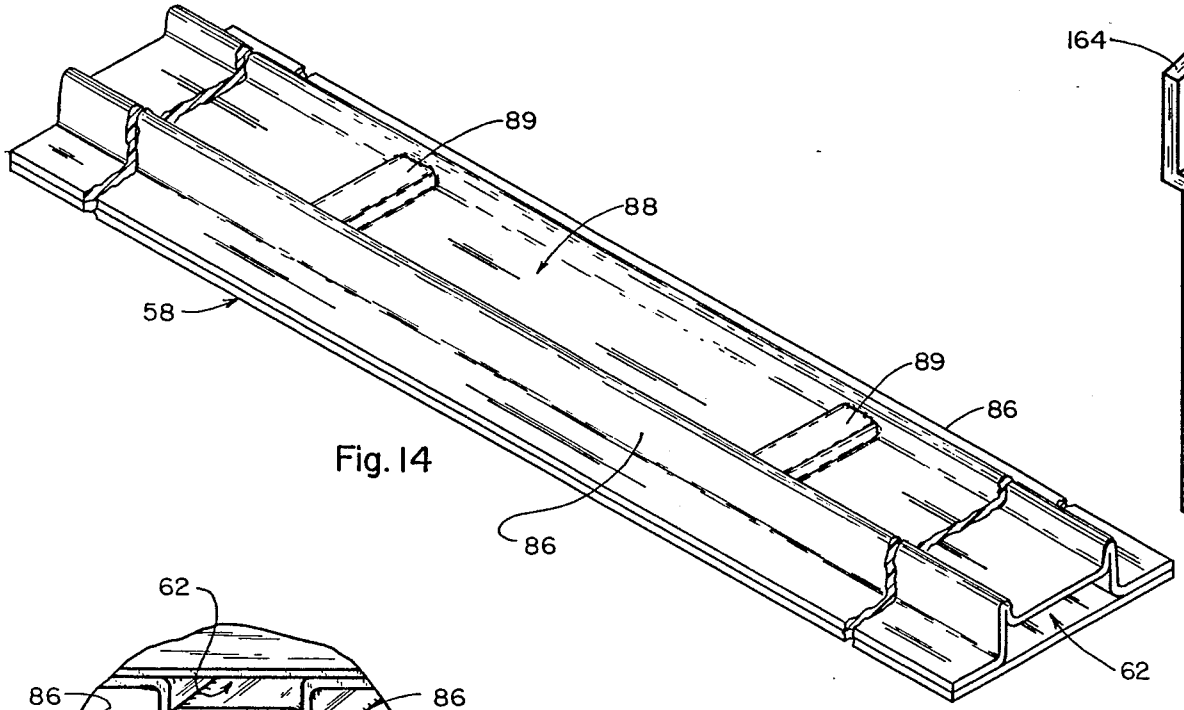
FIG. 14 is a perspective view of one embodiment of the bracket receiving means having the optional center support bracket stop means incorporated therein.

In addition, optional stop means in the form of raised projections 89 as shown in FIG. 14 may be positioned within the U-shaped cavity 88 of the receiving means 58 at locations adjacent the opposite end portions of the center bracket portion 74 to help prevent the bracket portion 74 from moving laterally during use. The projections 89 are positioned and located such that each opposite end of the bracket portion 74 abuts one of the projections 89 when the bracket 72 is positioned and secured between the upper and lower shelf members 20 as previously explained. This prevents lateral movement of the entire bracket 72 and keeps the bracket leg portions 76 and 78 substantially vertical at all times during use so that they do not interfere with the movement of the products positioned in the guide channels 36 located immediately adjacent thereto.

The center support brackets 72 provide ample support for the products positioned upon the upper shelf unit 20 and likewise add stability and rigidity to the overall two-tier arrangement 53. It is also recognized that the brackets 54 and 72 are appropriately dimensioned and sized depending upon the size of the products to be displayed thereon so that adequate space exist between the upper and lower shelf members to both accommodate such products and facilitate the gravity feeding thereof.

Figure 15:
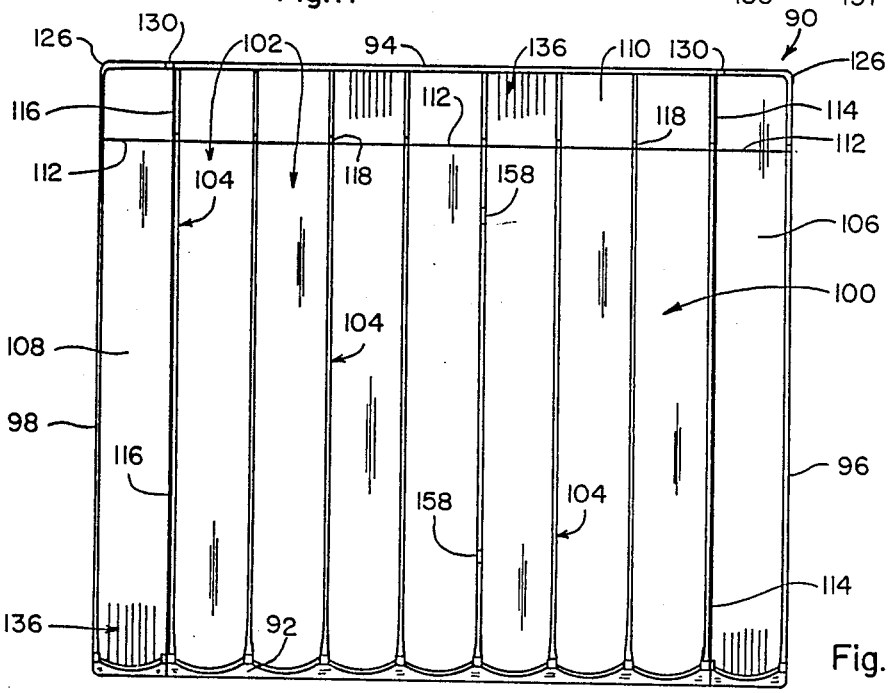
FIG. 15 is a top plan view of another embodiment of the present shelving unit having frangible side and rear portions.
Figure 16:
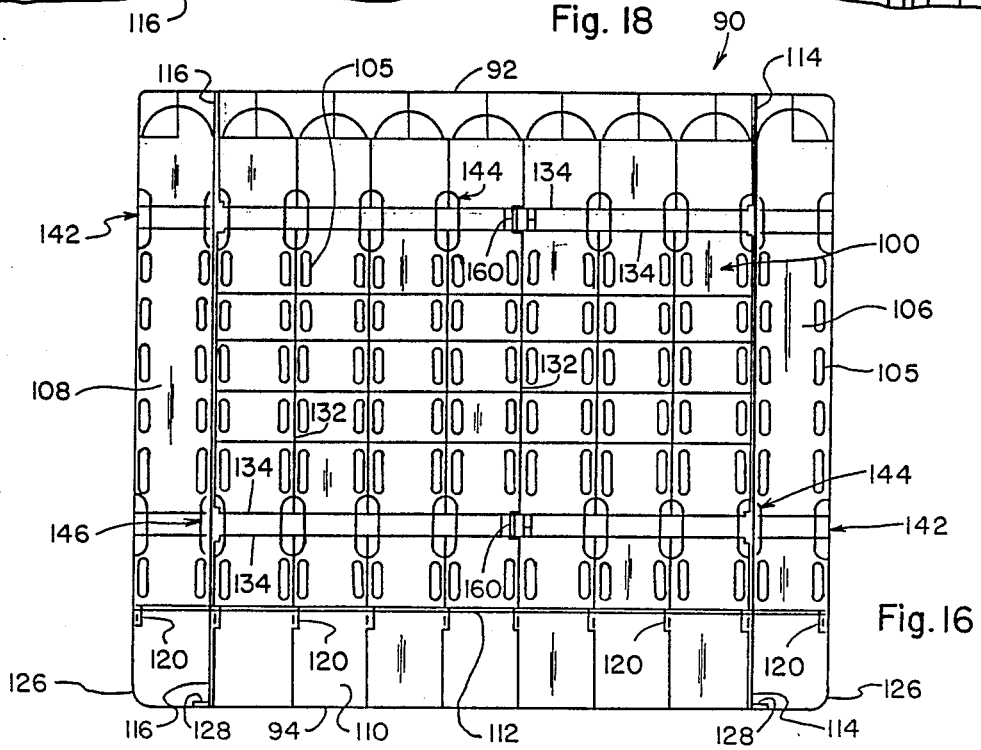
FIG. 16 is a bottom view of the shelving unit shown in FIG. 15 showing the support gridwork structure on the underside thereof.

Another embodiment of the subject invention discloses a shelf structure 90 as shown in FIG. 15 constructed substantially similar to the shelf member 20 shown in FIG. 1. The shelf member 90, unlike the shelf 20, is primarily designed to be made by an injection molding process and includes front and rear walls 92 and 94, opposed side walls 96 and 98, and a floor portion 100 which extends substantially the full length and width of the shelving unit 90 as shown in FIGS. 15 and 16. A plurality of guide channels 102 similar to the guide channels 36 are defined between a plurality of spaced, upstanding partitions 104 similar to the arrangement shown in FIG. 1 with respect to the shelf member 20. The shelf member 90 also includes frangible side portions 106 and 108 which are similar to the frangible portions 40 and 42 discussed above and, in addition, includes a frangible rear portion 110 which is defined by the weakened fracture line 112. The fracture line 112 extends substantially between the opposite side walls 96 and 98 at an intermediate location spaced between the front and rear walls 92 and 94 as shown in FIGS. 15–18. Like the shelf members 20, the shelf members 90 may be either singularly used to organize and merchandise products therefrom or may be likewise arranged in a two-tier system. Since the shelf member 90 is substantially similar to the shelf member 20, it is important to note that adding the rear frangible portion 110 necessitates improved structural features which strengthen the support capability of the unit 90 when the units 90 are utilized in a two-tier arrangement as will be hereinafter explained. This is necessary so that the upper shelf member can adequately support the weight of the various products or other containers positioned thereon particularly when the frangible rear portion and at least one frangible side portion is detachably removed.

Figure 18:
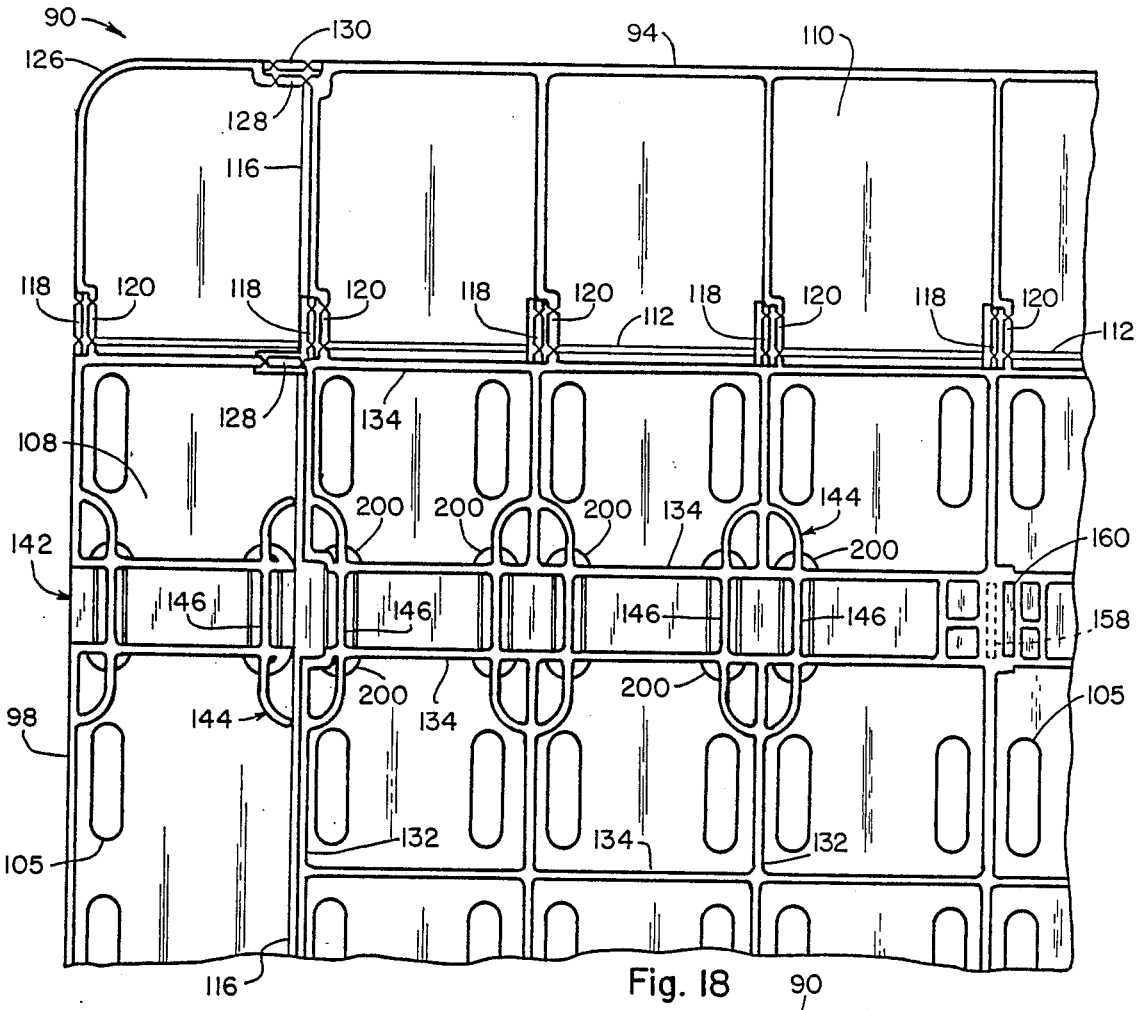
FIG. 18 is an enlarged fragmentary bottom view of the shelving unit of FIG. 15 showing the support grid structure on the underside thereof in greater detail.

The improved structural features associated with the shelf member 90 includes a support gridwork arrangement on the underside portion thereof and a plurality of removable tabs which connect the frangible portions with the rest of the shelf structure 90 as best shown in FIGS. 16 and 18. The shelf member 90 is preferably formed by an injection molding process, which process facilitates the fabrication of the finely detailed gridwork structure on the bottom portion of the shelf 90 and, in addition, substantially reduces manufacturing costs as compared to vacuum or thermo forming and other such processes. However, the present shelf member 90 as well as the shelf member 20 are not intended to be limited to a single manufacturing process and different manufacturing processes may be used as desired while still embodying the present inventive concept. The gridwork structure on the bottom portion of the shelf 90 is only necessary when the shelves 90 are used in a two-tier arrangement as previously explained and therefore, when used as a single unit, the gridwork structure can be eliminated and the unit 90 can be made having a substantially smooth and flat bottom surface as will be more fully explained hereinafter.

Figure 17:
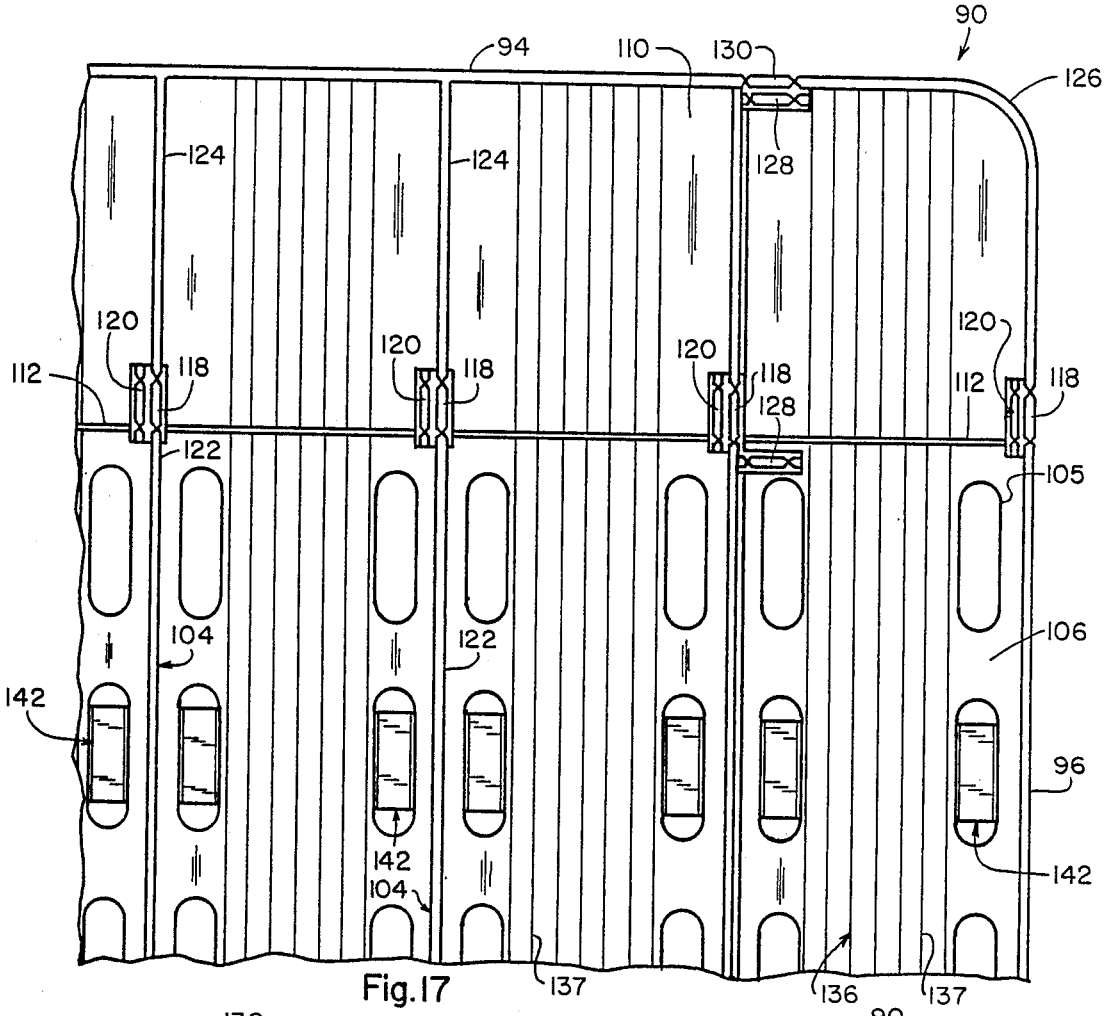
FIG. 17 is an enlarged fragmentary top plan view of the shelving unit of FIG. 15.

The plurality of removable tabs are generally positioned along the weakened fracture line 112 defining the rear frangible portion, and along the fracture lines 114 and 116 which define the frangible side portions 106 and 108 respectively. More particularly, a plurality of tabs 118 and 120 are positioned along the fracture line 112 and are generally in alignment with the partitions 104. The tabs 118 are located above the floor portion 100 and lie in direct alignment with the partitions 104 as best shown in FIGS. 15 and 17, while the tabs 120 are located below the floor portion 100 and are slightly offset from the tabs 118 as shown in FIGS. 16 and 18. Also, an additional tab 118 lies in alignment with and connects each of the opposed side walls 96 and 98 with a respective rear corner side wall portion 126 as shown in FIGS. 17 and 18. The tabs 118 and 120 serve to strengthen the overall shelving unit, which is especially important along the fracture line 112 defining the frangible rear portion 110 when the rear portion 110 has not been fractured and discarded. More specifically, the tabs 118 interconnect the partition portions 124 with the portions 122 associated with the non-frangible portion of the shelf member 90 to add strength and stability thereto while the tabs 120 interconnect the under structure of the frangible rear portion 110 with the support gridwork formed on the non-frangible bottom portion of the shelf member 90 as shown in FIGS. 16 and 18. This additional structure is needed to prevent the frangible rear portion 110 from inadvertently snapping off and damaging the goods placed thereon when used in a two-tier arrangement. The tabs 118 and 120 can be easily snapped and broken off by use of a pair of pliers or a simple slotted bar or other similar tool and once these tabs are broken, the frangible rear portion 110 may be easily detachably removed by using a similar procedure as previously described with respect to removing the frangible side portions 40 and 42 associated with the shelf member 20. This enables a user to easily adjust the overall depth of the shelf member 90.

Removal of the frangible side portions 106 and 108 is accomplished by snapping and breaking off the tabs 128 and 130 shown in FIGS. 17 and 18. The tabs 128 are located below the floor portion 100 on the underside of the shelf member 90 and interconnect the gridwork associated with the frangible portions 106 and 108 with the gridwork associated with the non-frangible portion of the shelf 90 while the tabs 130 are located above the floor portion 100 and lie in alignment with the rear wall 94 as best shown in FIGS. 15 and 17. A single tab 130 is associated with each of the frangible side portions 106 and 108 and they likewise interconnect the frangible side portions with the rear wall 92 as shown. Once the tabs 128 and 130 are broken, the frangible side portions 106 and 108 may be easily detachably removed as previously explained.

The support gridwork on the bottom of the shelf member 90 includes a plurality of downwardly extending wall members or ribs 132 which are aligned with and opposed to the partitions 104, and a plurality of downwardly extending wall members or ribs 134 which are perpendicular to the rib members 132 and which serve as cross-structure in conjunction therewith. Additional support along the fracture lines 112, 114 and 116 is especially important when the frangible side portions 106 and 108, and/or the frangible rear portion 110 of the upper unit in a two-tier system have been broken off since this removes the support provided by the rear corner walls 126. This additional support and strength is provided by the rib members 132 and 134 which lie adjacent to the respective fracture lines 112, 114 and 116 as shown in FIGS. 16 and 18.

The shelf member 90 is ideally suited for manufacture by the injection molding process since this process facilitates the forming of the detailed gridwork structure shown in FIGS. 16 and 18 and likewise facilitates the forming of the various tab members. Also, the injection molding process allows the plurality of track members 136 (FIGS. 15 and 17) upon which the products rest and slide to be integrally formed with the shelf 90, as opposed to being adhesively or otherwise attached within the guide channels as are the track members 38 shown in FIG. 2. Integrally forming the tracks 136 and the shelf structure 90 further reduces the cost of manufacturing by eliminating the labor needed to affix the track members to the floor portion of the shelf structure. Also, like the track members 38, the tracks 136 likewise include thinner and taller ribs or runners 137 to improve the wearability of such runners, particularly when such tracks are supporting the sliding movement of glass bottom containers as previously explained.

Figure 19:
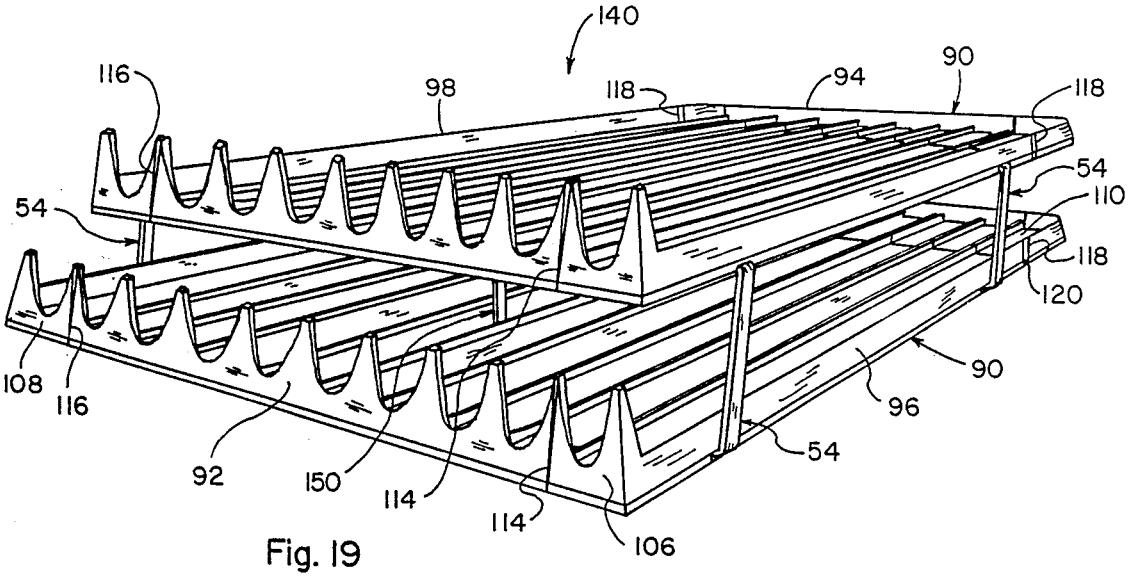
FIG. 19 is a perspective view of a pair of the shelving units of FIGS. 15–18 arranged in spaced apart relationship to form a two-tier product merchandising display system.
Figure 21:
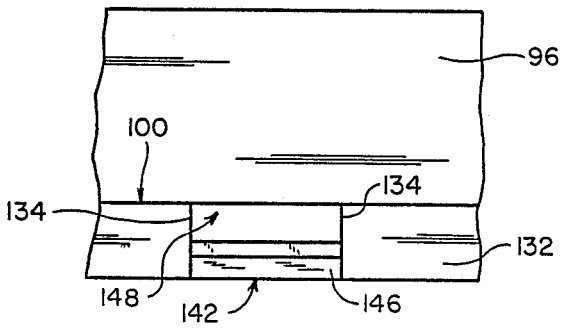
FIG. 21 is a partial side elevational view of the shelving unit of FIGS. 15–18 showing the bracket receiving means integrally formed therewith.
Figure 20:
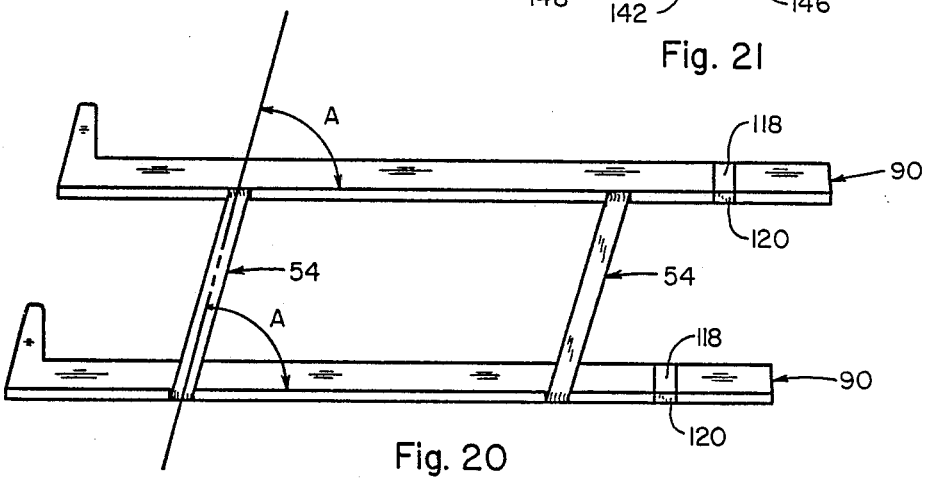
FIG. 20 is a side elevational view of the two-tier display system of FIG. 19.

FIGS. 19 and 20 illustrate use of the subject shelving units 90 in a two-tier arrangement 140 similar to the arrangement illustrated in FIGS. 6 and 7 with respect to the shelf members 20. Mounting of the shelf units 90 one above the other is likewise accomplished by use of the identical C-shaped brackets 54 shown in FIGS. 9 and 10. Like the shelf members 20, the shelf members 90 include bracket receiving means 142 for receiving the upper and lower leg portions 64 and 66 of the bracket members 54. The bracket receiving means 142 differ from the bracket receiving means 56 and 58 in that they are integrally formed within the support gridwork structure associated with the underside portion of the shelf member 90 as best shown in FIGS. 16–18 and 21. The receiving means 142 is defined by two of the transverse rib members 134, a portion of the floor 100, and a plurality of oval-shaped support wall members 144 as best shown in FIG. 18 and 21. The oval-shaped wall portions 144 each include a pair of wall segments 146 which extend substantially perpendicular across the lower portion of the transverse rib members 134. The wall segments 146 are positioned in spaced apart relationship from the floor portion 100 thereby defining an opening or aperture 148 within the bracket receiving means 142 to cooperatively receive one of the two leg portions associated with the C-shaped bracket members 54. The receiving means 142 extends widthwise across the entire shelf member 90 including the frangible side portions 106 and 108 as shown in FIGS. 16-18. It should be noted that the bracket receiving means 142 associated with each of the frangible side portions 106 and 108 is not interconnected with the bracket receiving means 142 associated with the remainder portion of the shelf member 90 (FIG. 18) but instead is discontinuous therefrom at the fracture lines 114 and 116. This means that when the frangible side portions 106 and 108 are detachably removed from the shelf member 90, that portion of the receiving means 142 associated respectively therewith is likewise removed leaving intact the remainder thereof for use in conjunction with the C-shaped brackets 54. Installation and use of the bracket members 54 is as previously described with respect to the two-tier embodiment 53 shown in FIGS. 6 and 7.

Figure 23:
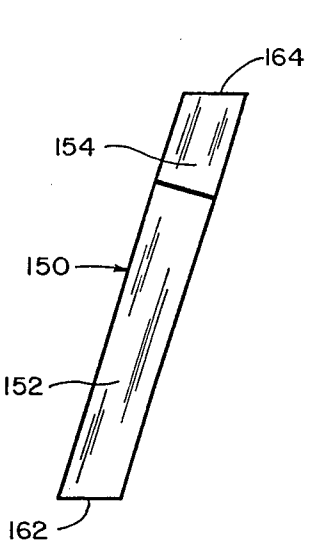
FIGS. 23 is a side elevational view of the support bracket of FIG. 22.
Figure 22:
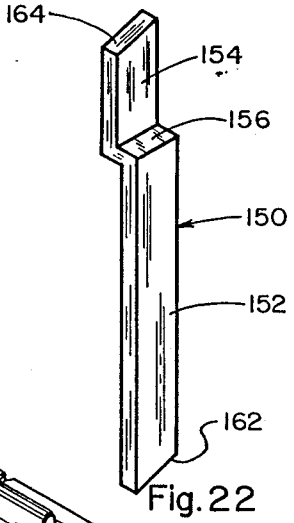
FIG. 22 is a perspective view of one of the center support brackets utilized in the two-tier arrangement shown in FIGS. 19 and 20.

Unlike the U-shaped center support brackets 72 utilized in the two-tier arrangement 53 (FIGS. 6, 11 and 12), the two-tier embodiment 140 utilizes a pair of center support brackets 150 as shown in FIGS. 22 and 23. The support brackets 150 include a lower portion 152, an upper portion 154, and an intermediate offset portion 156. Like the support brackets 72, the support brackets 150 are preferably integrally casted or formed from metal or some other durable material. Slots 158 are likewise provided on one of the center partitions 104 (FIG. 15) and are adaptable for receiving the terminal end of the lower bracket portion 152. Similarly, slots 160 (FIGS. 16 and 18) are provided on the underside portion of the shelf member 90 and are adaptable for receiving the terminal end of the upper bracket portion 154. The slots 160 are positioned and arranged slightly offset from and adjacent to the slots 158 as best shown in FIG. 18. In this regard, the bracket portion 156 provides the necessary offset so that proper alignment of the bracket portions 152 and 154 with the offset slots 158 and 160 can be achieved. The terminal end portion of each bracket portion 152 and 154 also includes an angled portion 162 and 164 respectively as shown in FIG. 22. As with the angled portion 82 associated with the bracket 72 (FIGS. 11 and 12), the amount of angularity associated with the portions 162 and 164 should be such that when the bracket member 150 is positioned within the respective slots 158 and 160 and rest upon the terminal end portions 162 and 164, the bracket portions 152 and 154 are angularly displaced an amount approximately equal to the angle A associated with the connecting portion 68 of the brackets 54 as shown in FIGS. 19 and 23. In this regard, the angled portions 162 and 164 run in opposite directions to each other such that each terminal end is substantially horizontal as shown in FIG. 23 when properly positioned and seated within the respective slots 158 and 160.

The two-tier embodiment 140 illustrated in FIGS. 19 and 20 is even more versatile than the two-tier arrangement 53 illustrated in FIGS. 6 and 7 since the shelf members 90 can be adjusted both widthwise and depthwise to accommodate existing shelf structures of varying depths and widths. Also, since the construction of the bracket receiving means 142 is identical on all of the shelf members 90, interchangeability of such shelf members in a two-tier arrangement is achieved. This increases the usefulness and marketability of this particular embodiment.

Although the shelf member 90 illustrated in FIGS. 15-21 is primarily designed to be used in a two-tier arrangement as shown in FIGS. 19 and 20, the units 90 can likewise be singularly used as previously explained to organize and merchandise products therefrom. In this situation, the gridwork structure associated with the underside portion of the shelf 90 (FIGS. 16 and 18) is not needed as the unit will be adequately supported by the support structure upon which it will be positioned. Therefore, for this particular application, the gridwork structure associated with the shelf unit 90 shown in FIGS. 16 and 18, including the tabs 120 and 128, can be eliminated and the shelf members 90 can be manufactured with a substantially flat and smooth underside portion. Only the tabs 118 and 130 on the top portion of the unit 90 need be retained to effect removal of the frangible side and rear portions 106, 108 and 110. This is important because removal of the gridwork structure substantially reduces the overall height of the unit as can be easily envisioned from viewing FIGS. 20 and 21. This saves vertical space when positioning the modified units 90 (without the underlying gridwork) in conventional refrigerated coolers and other adjustable shelf systems and enables more such units and therefor more product to be arranged in a given vertical space. The top view of this modified shelf 90 is substantially identical to the view of the shelf member 90 illustrated in FIG. 15.

Figure 24:
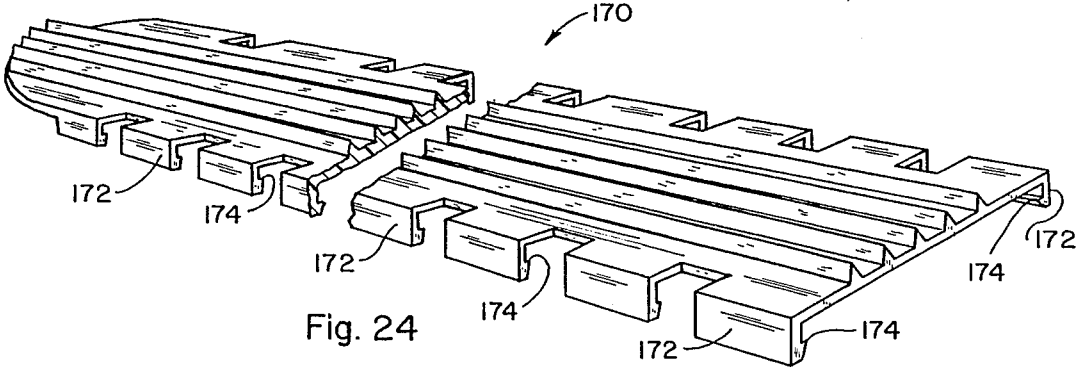
FIG. 24 is a perspective view of one embodiment of a track member for supporting glass bottom containers thereon.

FIG. 24 illustrates a track member which may be specifically designed for supporting glass bottom containers. Generally, the improved design of track members 38 and 136, whether mounted to or integrally formed with the respective shelf members 20 and 90, are capable of handling the sliding movement of glass bottom containers therealong because of the improved wearability afforded by the thinner and taller runners associated therewith as previously explained. Nevertheless, because glass bottom containers do pose a special problem in that they cause the upstanding ribs or runners on the track members to wear more rapidly than other types of container materials, in some applications, a special track member designed specifically to further improve the wearability and slidability of the runners supporting glass bottom containers such as the track member 170 (FIG. 24) may be desired. These special track members may be adhesively attached to the floor portion of the shelf structure, either directly thereto or by placing the special track member over the existing track member, or they may be constructed so as to be cooperatively engageable with the shelf unit. The track member 170 (FIG. 24) is preferably of unitary construction and is extruded or molded from a high density polyethylene mixed or impregnated with an appropriate amount by weight of a fatty amide such as erucamide which is an unsaturated fatty monoamide derived from erucic acid. It has been found that mixing a high density polyethylene with about $1\% \pm 0.05\%$ by weight of a fatty amide such as erucamide produces a suitably lubricated track surface for supporting and improving the slidability of glass bottom containers positioned thereon. The special track member 170 includes cooperatively engageable means in the form of a plurality of downwardly extending projections 172 positioned adjacent both opposite sides thereof which can be insertably received through the ventilation openings 52 associated with the shelf member 20, or through the air circulation openings 105 associated with the shelf member 90. The projections 172 are appropriately sized and dimensioned according to the particular sized openings through which they will be inserted and are designed to be mounted over the existing track members 38 and 136. The projections 172 also preferably each include means such as the lip portion 174 which can engage the spaced surfaces associated with the respective floor portions to maintain the track members 170 engaged therewith. The lip portions 174 are yieldable and when the projections 172 are forcibly inserted within the openings 52 or 105, the lip portions 174 become engaged therewith by being cammed outwardly during insertion. In addition, the projections 172 can be dimensioned widthwise such that a portion of each ventilation opening through which the projections 172 are inserted remain unobstructed so that cool air may still circulate around and between the products positioned on the shelf members when used in a refrigerated cooler.

While all of the embodiments of the subject display unit discussed above may be utilized on relatively flat, horizontal shelves to attractively organize products supported thereby, these same embodiments are preferably utilized on inclined shelf members such that products placed thereon can easily slide under the force of gravity towards the front of the unit to provide a convenient, continuous supply of products within easy reach of consumers. Certain known types of shelving systems such as the ARDCO and ANTHONY load carrying rack systems are particularly adaptable for conversion to a gravity feed type operation by simply elevating the rear portion of the shelves to achieve an inclination such that when the present shelving units are positioned thereon, rows of products positioned on the respective track members will automatically slide under the force of gravity toward the front portion of the unit in a smooth and steady manner and without toppling over.

Figure 25:
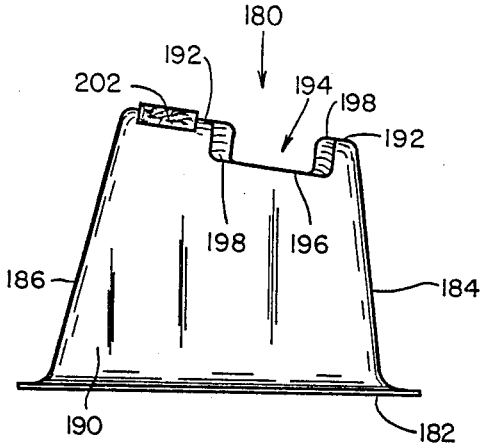
FIGS. 25 and 26 side elevational and top plan views respectively of a pedestal member used in conjunction with the shelf member of FIGS. 15–18 to convert said shelf member into a gravity feed system.
Figure 26:
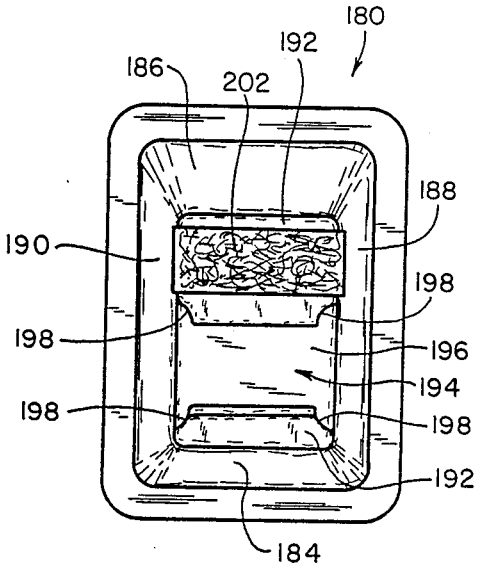
Figure 27:
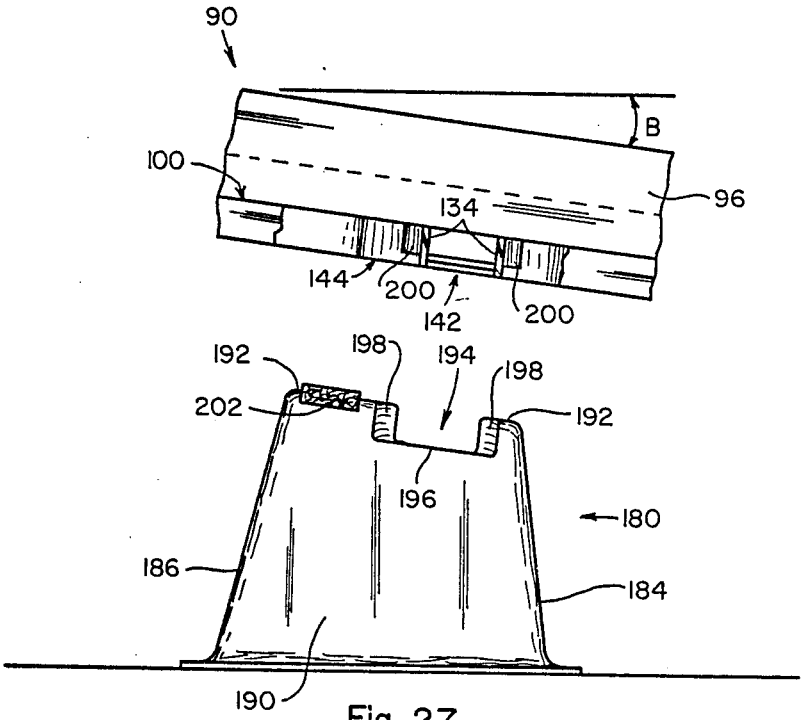
FIG. 27 is a fragmentary exploded side elevational view showing how the pedestal member of FIGS. 25 and 26 mates with and engages the shelf member of FIGS. 15–18.

In addition, FIGS. 25 and 26 disclose a pedestal or leg support member 180 which is specifically designed for use with the shelf member 90 (FIGS. 15–21) to elevate the rear portion thereof to achieve a gravity feed orientation when the shelves 90 are utilized on a relatively flat supporting surface. The pedestal member 180 can be used to elevate either a single shelf member 90 or the two-tier arrangement shown in FIGS. 19 and 20 and includes a lower base portion 182 having spaced front and rear walls 184 and 186, and spaced side walls 188 and 190 extending upwardly therefrom forming an upper floor portion 192. The walls 184, 186, 188, and 190 support the floor 192 in an elevated inclined position sloping forwardly from the rear wall 186 towards the front wall 184 as best shown in FIG. 25. The floor 22 is acutely angularly related to the lower base portion 182 and includes a recessed portion or cavity 194 having a bottom wall portion 196 positioned parallel thereto as shown in FIGS. 25 and 27. The cavity 194 is specifically dimensioned to receive and frictionally engage the two transverse rib members 134 which define a portion of the bracket receiving means 142 extending across the bottom portion of any one of the guide channels 102 as shown in FIG. 27. Likewise, the concave portions 198 associated with the cavity 194 are specifically designed to frictionally mate with the convex projections 200 associated with bracket receiving means 142 (FIGS. 18 and 27).

When the pedestal or leg support member 180 is supported on a substantially flat support surface and is properly positioned beneath the shelf member 90, the pedestal floor 192 engages the smooth bottom surface of the shelf floor 100 between the downwardly extending ribs 132 associated with the support gridwork and imparts the desired inclination to the shelf 90. Any number of pedestal members 180 may be used across the rear portion of the shelf members 90 to adequately support the same in an inclined position for gravity feed operation. Use of a plurality of members 180 converts the shelf member 90 to a gravity feed device and inclines the respective guide channels 102 such that when rows of products are positioned therewithin and supported on the track members 136 they will slide under the force of gravity towards the front end portion of the shelf 90. A shelf inclination or slope such as the angle of inclination B in FIG. 27 of between about 7° to 8° provides a desirable condition for gravity feed operations although other inclination angles or slopes may likewise provide suitable results for some applications depending upon the nature of the goods being merchandised. An optional adhesive pad, such as the adhesive pad 202, may likewise be utilized on the pedestal floor surface 192 as shown in FIGS. 25–27 to further secure the member 180 in the proper position with the shelf member 90.

The various embodiments of the subject invention greatly facilitate the conversion of conventional shelf structures including shelving in conventional refrigerated coolers into gravity feed devices and also greatly increase the product capacity of such conventional devices.

Thus there has been shown and described several embodiments of a novel adjustable shelving unit for use in storing and merchandising shelved products, including products requiring refrigeration, which devices are easily adapted for mounting in a two-tier arrangement and fulfill all of the objects and advantages sought therefor. Many changes, modifications, variations, and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A one-piece shelving unit for merchandising products arranged in rows comprising a base member having a front wall portion, a rear edge, opposed side walls and a floor portion extending therebetween, spaced parallel upstanding walls extending upwardly from said floor portion dividing said floor portion into adjacent portions extending in one direction from said front wall towards said rear edge, said upstanding walls defining therebetween a plurality of channels for receiving and supporting products positioned therewithin, and means extending transversely across said base member between said opposed side walls at an intermediate location between said front wall and said rear edge for weakening said base member whereby said base member can be broken along said weakening means into separate front and rear portions.

2. A shelf unit adaptable to be supported on a support surface comprising a base member having front, rear and opposed side walls and a floor portion extending therebetween, said floor portion including a plurality of upstanding walls defining a plurality of channels extending between said front and rear walls, track means positioned within and extending along each of said channels for supporting products positioned thereon, means forming a fracture line of reduced cross-section extending transversely across said base member between said opposed side walls at an intermediate location between said front and rear walls whereby said base member can be severed along said fracture line into separate front and rear portions, spaced wall members extending transversely across and downwardly from the bottom surface of said shelf unit, and a leg support member having a first lower end portion for resting on the support surface and a second upper end portion, said second upper end portion being cooperatively engageable with said spaced wall members to support said shelf unit thereat in spaced relationship above the support surface.

3. A product merchandising display unit comprising a pair of similar shelf members to be arranged in spaced parallel relationship one above the other, each of said shelf members having a front, rear and opposed side edges and a plurality of bracket receiving openings extending transversely across at least a portion of the bottom surface thereof from the opposed side edges, a plurality of support brackets each including spaced parallel end portions and a central connecting portion therebetween, each of the said parallel end portion being oriented at an angle acutely related to the longitudinal dimension of said central connecting portion, the cross-sectional dimension of the bracket members substantially corresponding to the cross-sectional shape of the bracket receiving openings whereby when the respective end portions of each bracket member are positioned extending into corresponding bracket receiving openings in the spaced shelf members the bracket members will maintain said pair of shelf members in spaced parallel relation, one of said shelf members being offset relative to the other by the angular relationship between the parallel end portions of each of said bracket members and the longitudinal dimension of said central connecting portions.

4. A product merchandising display unit comprising a pair of similar shelf members and means for maintaining said shelf members in spaced parallel relationship, each of said shelf members having a top surface, a bottom surface, and front, rear and opposed side edges, a plurality of transverse bracket receiving passages associated with each of said shelf members and extending transversely across at least a portion of the bottom surface thereof, a plurality of bracket members for cooperative engagement with said bracket receiving passages to connect said shelf members together in spaced relation, each of said bracket members including an elongated member having a cross-sectional shape defined by a width dimension and a thickness dimension, said width dimension being substantially greater than said thickness dimension, each of said elongated members having first and second end portions and a connection portion extending therebetween, the orientation of said first and second end portions being such that when the width dimensions thereof are oriented in a horizontal plane the connection portion will be oriented at an angle relative to the vertical, one of the end portions of each of said bracket members being positioned extending into said bracket receiving passages on one of said shelf members and the other of said bracket end portions be positioned extending into the corresponding bracket receiving passages in said other shelf member, each of said shelf members having a reduced cross-sectional portion extending transversely thereacross whereby the portions thereof on opposite sides of said reduced cross-sectional portion can be angularly displaced relative to each other to separate said shelf portions into separate portions on opposite sides thereof.

5. A shelving unit for merchandising products arranged in rows comprising a base member having a front wall portion, a rear edge, opposed side walls and a floor portion extending therebetween, spaced parallel upstanding walls extending upwardly from said floor portion dividing said floor portion into adjacent portions extending in one direction from said front wall towards said rear edge, said upstanding walls defining therebetween a plurality of channels for receiving and supporting products positioned therewithin, means extending transversely across said base member between said opposed side walls at an intermediate location between said front wall and said rear edge for weakening said base member whereby said base member can be broken along said weakening means into separate front and rear portions, track means positioned in and extending along each of said channels, said track means including spaced upstanding ribs upon which products are supported for sliding movement therealong, said track means further including means cooperatively engageable with said base member.

6. A shelving unit for merchandising products arranged in rows comprising a base member having a front wall portion, a rear edge, opposed side walls and a floor portion extending therebetween, spaced parallel upstanding walls extending upwardly from said floor portion dividing said floor portion into adjacent portions extending in one direction from said front wall towards said rear edge, said upstanding walls defining therebetween a plurality of channels for receiving and supporting products positioned therewithin, first means extending transversely across said base member between said opposed side walls at an intermediate location between said front wall and said rear edge for weakening said base member whereby said base member can be broken along said first weakening means into separate front and rear portions, and second means for weakening said base member adjacent to at least one of said upstanding walls whereby said base member can be broken along said second weakening means into separate portions on opposite sides thereof.

7. The shelving unit defined in claim 1 including other means for weakening said base member adjacent to one of said upstanding walls whereby said base member can be broken along said other weakening means into separate portions on opposite sides thereof.

8. The shelving unit defined in claim 1 wherein each of said channels in said base member has spaced openings formed therethrough.

9. The shelving unit defined in claim 1 including track means positioned in and extending along each of said channels, said track means including spaced upstanding ribs upon which products are supported for sliding movement therealong.

10. The shelving unit defined in claim 1 including means for mounting at least two of said shelving units in spaced parallel relationship one above the other.

11. The shelving unit defined in claim 1 wherein said means for weakening said base member include means forming an aligned region of reduced cross-section capable of being ruptured when portions of the base member on opposite sides thereof are deflected angularly relative to one another.

12. The shelving unit defined in claim 5 wherein said cooperatively engageable means include spaced yieldable means on said track means engageable with spaced surfaces on said base member whereby said yieldable means become engaged with said base member by being cammed outwardly during assembly.

13. The shelving unit defined in claim 9 wherein said track means are formed from a mixture of materials including a high density polyethylene and a fatty amide.

14. The shelving unit defined in claim 9 wherein the said upstanding ribs have triangularly shaped cross-sections extending from an upper apex to a base, the height of said ribs being substantially greater than the width thereof at said base.

15. The shelving unit defined in claim 14 wherein the height of the triangularly shaped cross-sectional ribs are at least twice as great as the width thereof at said base.

16. The shelf unit defined in claim 2 including other means forming a fracture line of reduced cross-section across said base member between said front and rear walls and adjacent to one of said upstanding walls whereby said base member can be severed along said other fracture line into separate portions on opposite sides thereof.

17. The shelf unit defined in claim 16 wherein at least one of said channels is located between said other fracture line and one of said opposed side walls.

18. The shelf unit defined in claim 2 wherein the second upper end portion of said leg support member is acutely angularly related to said first lower end portion.

19. The shelf unit defined in claim 2 wherein the second upper end portion of said leg support member includes optional means for adhesive attachment to the shelf unit.

20. The product merchandising display unit defined in claim 3 including at least one center support bracket positioned between said spaced shelf members at an intermediate location, each of said shelf members having bracket engaging means located at an intermediate location on the upper and lower surfaces thereof.

21. The product merchandising unit defined in claim 3 wherein the parallel end portions on each of the bracket members are angularly oriented in a range from about 16° to about 17° relative to the longitudinal dimension of the central connecting portion.

22. The product merchandising display unit defined in claim 20 wherein the bracket engaging means on the lower surface of at least one of said shelf members includes stop means for limiting the movement of said center support bracket when engaged therewith.

23. The product merchandising display unit defined in claim 3 wherein each of said shelf members includes means extending transversely across said member between said opposed side edges at an intermediate location spaced from said front and rear edges for weakening said member whereby each of said members can be broken along said weakening means into separate front and rear portions.

24. The product merchandising display unit defined in claim 3 wherein each of said shelf members includes other means for weakening said member extending in a direction substantially parallel to and spaced from said opposed side edges between said front and rear edges whereby each of said members can be broken along said other weakening means into separate portions on opposite sides thereof.

25. The product merchandising display unit defined in claim 3 wherein said bracket receiving openings are integral with said shelf members.

26. The product merchandising display unit defined in claim 3 wherein said shelf members include track means for supporting products positioned thereon.

27. The product merchandising display unit defined in claim 3 wherein said transverse bracket receiving openings are defined in part by spaced wall members extending transversely across and downward from the bottom surface of each shelf member, and a leg support member having a first lower end portion for resting on a support surface and a second upper end portion, said second upper end portion being cooperatively engageable with said spaced wall members to support the shelf member thereat in spaced relationship above the support surface.

28. The product merchandising display unit defined in claim 27 wherein the second upper end portion of said leg support member is acutely angularly related to said first lower end portion.

29. The product merchandising display unit defined in claim 27 wherein the second upper end portion of said leg support member includes optional means for adhesive attachment to the shelf member.

30. The product merchandising display unit defined in claim 4 wherein each of said shelf members includes a second portion of reduced cross-section extending between the front and rear edges thereof whereby the portions thereof on opposite sides of said reduced cross-sectional portion can be angularly displaced relative to each other to separate said shelf member into separate portions.

31. The product merchandising display unit defined in claim 4 wherein each of said shelf members includes a plurality of spaced wall portions extending between the front and rear edges thereof to define product carrying channels therebetween, each of said product carrying channels including a plurality of upstanding ribs having triangular shaped cross-sections extending from an upper apex to a base, the height of said ribs being substantially greater than the width thereof at said base.

32. The product merchandising display unit defined in claim 31 wherein the height of the triangularly shaped cross-sectional ribs are at least twice as great as the width thereof at said base.

33. The shelving unit defined in claim 1 including a plurality of removable tab members positioned generally adjacent to said weakening means.

34. The shelving unit defined in claim 33 wherein at least some of said plurality of tab members are located above said floor portion.

35. The shelving unit defined in claim 33 wherein at least some of said plurality of tab members are located below said floor portion.

36. The shelving unit defined in claim 7 including a plurality of removable tab members positioned generally adjacent to said other weakening means.

37. The shelving unit defined in claim 36 wherein at least one of said plurality of tab members is located above said floor portion.

38. The shelving unit defined in claim 36 wherein at least one of said plurality of tab members is located below said floor portion.

* * * * *

UNITED STATES PATENT OFFICE

CERTIFICATE OF CORRECTION

Patent No. 4,801,025 Dated January 31, 1989

Inventor(s) Paul L. Flum and Christopher C. Bidwell

It is certified that error appears in the above-identified patent and that said Letters Patent is hereby corrected as shown below:

In the Abstract, line 16, "avilable" should be --available--.

Column 5, line 9, after "26", insert --are--.

Signed and Sealed this

Fourth Day of July, 1989

*Attest:*

DONALD J. QUIGG

*Attesting Officer*

*Commissioner of Patents and Trademarks*